US008213824B2

(12) United States Patent
Cho et al.

(10) Patent No.: US 8,213,824 B2
(45) Date of Patent: Jul. 3, 2012

(54) HIGH VOLTAGE POWER CONTROLLING APPARATUS OF IMAGE FORMING APPARATUS AND METHOD THEREOF

(75) Inventors: Jong-hwa Cho, Suwon-si (KR); Chul-woo Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/024,537

(22) Filed: Feb. 10, 2011

(65) Prior Publication Data

US 2011/0129246 A1 Jun. 2, 2011

Related U.S. Application Data

(63) Continuation of application No. 11/969,348, filed on Jan. 4, 2008, now Pat. No. 7,907,864.

(30) Foreign Application Priority Data

Apr. 24, 2006 (KR) ..... 2007-40056

(51) Int. Cl.
*G03G 15/00* (2006.01)

(52) U.S. Cl. ..... 399/88

(58) Field of Classification Search ..... 399/88
See application file for complete search history.

(56) References Cited

U.S. PATENT DOCUMENTS 4,685,040 A * 8/1987 Steigerwald et al.
4,791,348 A * 12/1988 McGuire et al.
2003/0112297 A1* 6/2003 Hiratsuka et al.

FOREIGN PATENT DOCUMENTS

JP 08065893 A * 3/1996

OTHER PUBLICATIONS

Chinese Office Action Issued on Mar. 29, 2012 in CN Patent Application No. 200810008814.4.

* cited by examiner

*Primary Examiner* — David Gray
*Assistant Examiner* — Laura K Roth
(74) *Attorney, Agent, or Firm* — Stanzione & Kim, LLP

(57) ABSTRACT

A high voltage power controlling apparatus of an image forming apparatus including a DC (direct current) power controller to convert and output a first PWM (pulse width modulation) signal provided from an engine controller into a switching waveform signal, a first voltage transformer to transform the switching waveform signal output from the DC power controller, a rectifier to rectify output power transformed by the first voltage transformer into DC power, first through N(where N is a positive integer greater than one) DC supplies to adjust and output the DC power rectified by the rectifier such that the DC power is adjusted to a predetermined level, first through N AC (alternating current) power controllers to convert and output a second PWM signal provided from the engine controller into switching waveform signals, and second through N+1 voltage transformer to transform the switching waveform signals output from the first through N AC power controllers, to overlap the transformed powers with the DC powers having predetermined levels of the first through N DC supplies, and to output the overlapped powers to first through N developers, respectively.

5 Claims, 3 Drawing Sheets

HIGH VOLTAGE POWER CONTROLLING APPARATUS OF IMAGE FORMING APPARATUS AND METHOD THEREOF

CROSS-REFERENCE TO RELATED APPLICATIONS

This is a Continuation Application of prior U.S. application Ser. No. 11/969,348, filed on Jan. 4, 2008 now U.S. Pat. No. 7,907,864 in the U.S. Patent and Trademark Office, which claims priority under 35 U.S.C. 119(a) from Korean Patent Application No. 10-2007-0040056, filed on Apr. 24, 2007, in the Korean Intellectual Property Office, the disclosure of which is incorporated herein in its entirety by reference.

BACKGROUND OF THE INVENTION

1. Field of the Invention

The present general inventive concept relates to a high voltage power controlling apparatus of an image forming apparatus which reduces a number of voltage transformers that supply direct current (DC) power in a high voltage power supply which is applied to a laser printer or a laser multi-function peripheral device, so as to reduce both a size of the image forming apparatus and material costs, and a method thereof.

2. Description of the Related Art

FIG. 1 is a circuit diagram of a conventional high voltage power controlling apparatus supplied to each cyan (C), magenta (M), yellow (Y), and black (K) developer. Referring to FIG. 1, the conventional high voltage power controlling apparatus includes first through fourth alternating current (AC) power controllers 100, 110, 120, and 130, first through fourth voltage transformers 102, 112, 122, and 132, first through fourth direct current (DC) power controllers 104, 114, 124, and 134, fifth through eighth voltage transformers 106, 116, 126, and 136, and first through fourth rectifiers 108, 118, 128, and 138, in order to provide an overlap high voltage of AC and DC to each cyan (C), magenta (M), yellow (Y), and black (K) developer in an image forming apparatus using a single path method.

In order to output the AC high voltage, the first through fourth AC power controllers 100, 110, 120, and 130 generate waveforms. Then, the first through fourth voltage transformers 102, 112, 122, and 132 respectively amplify the waveforms of the first through fourth AC power controllers 100, 110, 120, and 130 to output AC power. Then, the first through fourth DC power controllers 104, 114, 124, and 134 output waveforms, and the fifth through eighth voltage transformers 106, 116, 126, and 136 and the first through fourth rectifiers 108, 118, 128, and 138 output the waveforms as DC power. Thus, the DC power overlaps with the AC power and then is output.

However, in the image forming apparatus using the single path method, Y, C, M, and K developers are distinguished from one another. Also, a number of DC power controllers and the number of AC power controllers must be each equal to a number of Y, C, M, and K developers in order to supply a high voltage developer voltage to each of the Y, C, M, and K developers. In addition, a number of voltage transformers and a number of rectifiers must be each greater than or equal to a number of Y, C, M, and K developers. As a result, the image forming apparatus becomes bulky and the material costs for the components constituting the image forming apparatus are high.

SUMMARY OF THE INVENTION

The present general inventive concept provides a high voltage power controlling apparatus of an image forming apparatus having a simplified circuit structure, which controls an overlapping power of an alternating current (AC) and a direct current (DC) that is supplied to each of yellow (Y), cyan (C), magenta (M), and black (K) developers, thereby reducing a bulkiness and manufacturing costs of the image forming apparatus, and a method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a high voltage power controlling apparatus of an image forming apparatus including a DC (direct current) power controller to convert and output a first PWM (pulse width modulation) signal provided from an engine controller into a switching waveform signal, a first voltage transformer to transform the switching waveform signal output from the DC power controller, a rectifier to rectify output power transformed by the first voltage transformer into DC power, first through N(where N is a positive integer greater than one) DC supplies to adjust and output the DC power rectified by the rectifier such that the DC power is adjusted to a predetermined level, first through N AC (alternating current) power controllers to convert and output a second PWM signal provided from the engine controller into switching waveform signals, and second through N+1 voltage transformer to transform the switching waveform signals output from the first through N AC power controllers, to overlap the transformed powers with the DC powers having predetermined levels of the first through N DC supplies, and to output the overlapped powers to first through N developers, respectively.

Each of the first through N DC supplies may include first and second resistors to divide the rectified DC power, an operational amplifier to compare a third PWM signal that is input into a positive node of the operational amplifier with a reference voltage that is input into a negative node of the operational amplifier, and to output a comparison signal, and a switching unit to perform a switching operation according to the comparison signal of the operational amplifier to adjust a power level of the DC power.

Each of the first through N DC supplies may further include a capacitor to smooth the ripples of the DC power having the adjusted power level.

The first through N developers may be respectively C (cyan), M (magenta), Y (yellow), and K (black) developers.

The foregoing and/or other aspects and utilities of the present general inventive concept may also by achieved by providing a high voltage power controlling apparatus of an image forming apparatus including a voltage transformer to transform a switching waveform signal output from a DC power controller, a rectifier to rectify output power transformed by the voltage transformer, a plurality of DC supplies to adjust and output the DC power rectifies by the rectifier to a predetermined level, and a plurality of voltage transformers to transform power respectively output from a plurality of AC power controllers.

The AC power controllers may transform a first PWM signal provided from an engine controller respectively into switching waveform signals.

Each of the DC supplies may include first and second resistors to divide the rectified DC power, an operational amplifier to compare a third PWM signal that is input into a positive node of the operational amplifier with a reference voltage that is input into a negative node of the operational amplifier, and to output a comparison signal, and a switching unit to perform a switching operation according to the comparison signal of the operational amplifier so as to adjust a power level of the DC power.

Each of the DC supplies may further include a capacitor to smooth the ripples of the DC power having the adjusted power level.

Each of the AC power controllers may convert a second PWM signal provided from the ending controller into a switching waveform signal.

Each of the voltage transformers may overlap DC power adjusted by the DC supplies.

The foregoing and/or other aspects and utilities of the present general inventive concept may also by achieved by providing a high voltage power controlling apparatus of an image forming apparatus, including a plurality of developing units to each expel a developer based on predetermined DC and AC power levels, a plurality of DC power adjustment units to each adjust an input DC power from a single DC power controller to the predetermined DC power levels, and a plurality of voltage transformers to each combine an AC power with each one of the plurality of adjusted DC powers and to output the combined AC and DC powers to respective ones of the plurality of developing units.

The high voltage power controlling apparatus of may further include a rectifier to output an identical rectified switching signal to each one of the plurality of DC power adjustment units, such that the rectified switching signal is the input DC power.

Each one of the plurality of DC power adjustment units may include a plurality of resistors to divide the input DC power, a comparator to output a comparison signal based on a comparison of another PWM signal and a reference voltage, and a switching unit to perform a switching operation according to the comparison signal to adjust the DC power.

The foregoing and/or other aspects and utilities of the present general inventive concept may also by achieved by providing a high voltage power controlling apparatus of an image forming apparatus, including a plurality of developing units to each expel a developer based on predetermined DC and AC power levels, a plurality of DC power adjustment units to each adjust an input DC power from a single DC power controller to the predetermined DC power levels, a plurality of AC power controllers to correspond to each of the plurality of DC power adjustment units and to each convert a PWM signal into a switching waveform signal, and a plurality of voltage transformers to transform each of the switching waveform signals output from the plurality of AC power controllers and to combine and output the transformed AC powers and the adjusted DC powers to the plurality of developing units.

The transforming of each of the switching waveform signals output from the plurality of AC power controllers may be based on turns ratios of each of the plurality of AC power controllers.

The foregoing and/or other aspects and utilities of the present general inventive concept may also by achieved by providing a high voltage power controlling apparatus of an image forming apparatus, including a plurality of developing units to each expel a developer based on predetermined DC and AC power levels, a plurality of AC power controllers to each generate an AC power, and a power adjusting unit to receive a single DC power and including a plurality of DC power adjustment units to each receive the single DC power and adjust the single DC power to correspond to the predetermined DC and AC power levels, and a plurality of first voltage transformers to combine each of the adjusted DC powers with the AC power generated by each of the AC power controllers and to output each of the combined AC and DC powers to one of the plurality of the developing units.

The high voltage power controlling apparatus may also include a DC power controlling unit to supply the DC power to the power adjusting unit, the DC power controlling unit comprising a DC power controller to convert and output a PWM signal provided from an engine controller into a switching waveform signal, a second voltage transformer to transform the switching waveform signal output from the DC power controller, and a rectifier to rectify the output power transformed by the second voltage transformer into the single DC power.

The transforming of the switching waveform signal output from the DC power controller may be based on a turns ratio of the second voltage transformer.

The foregoing and/or other aspects and utilities of the present general inventive concept may also by achieved by providing a method of controlling a high voltage power of an image forming apparatus, including converting and outputting a first PWM (pulse width modulation) signal into a switching waveform signal, transforming the switching waveform signal into an output power, rectifying the transformed output power into DC power, adjusting and outputting the rectified DC power such that the DC power is adjusted to a predetermined level in first through N DC (direct current) supplies, converting and outputting a second PWM signal into switching waveform signals in first through N AC (alternating current) power controllers, transforming the switching waveform signals output from the first through N AC power controllers to overlap the transformed powers with the DC powers having predetermined levels of the first through N DC supplies in a plurality of voltage transformers, and outputting the overlapped powers to first through N developers, respectively.

The foregoing and/or other aspects and utilities of the present general inventive concept may also by achieved by providing a method of controlling a high voltage power of an image forming apparatus, including adjusting identical input DC powers in the plurality of DC supplies to various differing predetermined DC power levels, combining each one of the adjusted DC powers with an AC power, and outputting each of the combined AC and DC powers to one of a plurality of developing units to expel developer therefrom.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
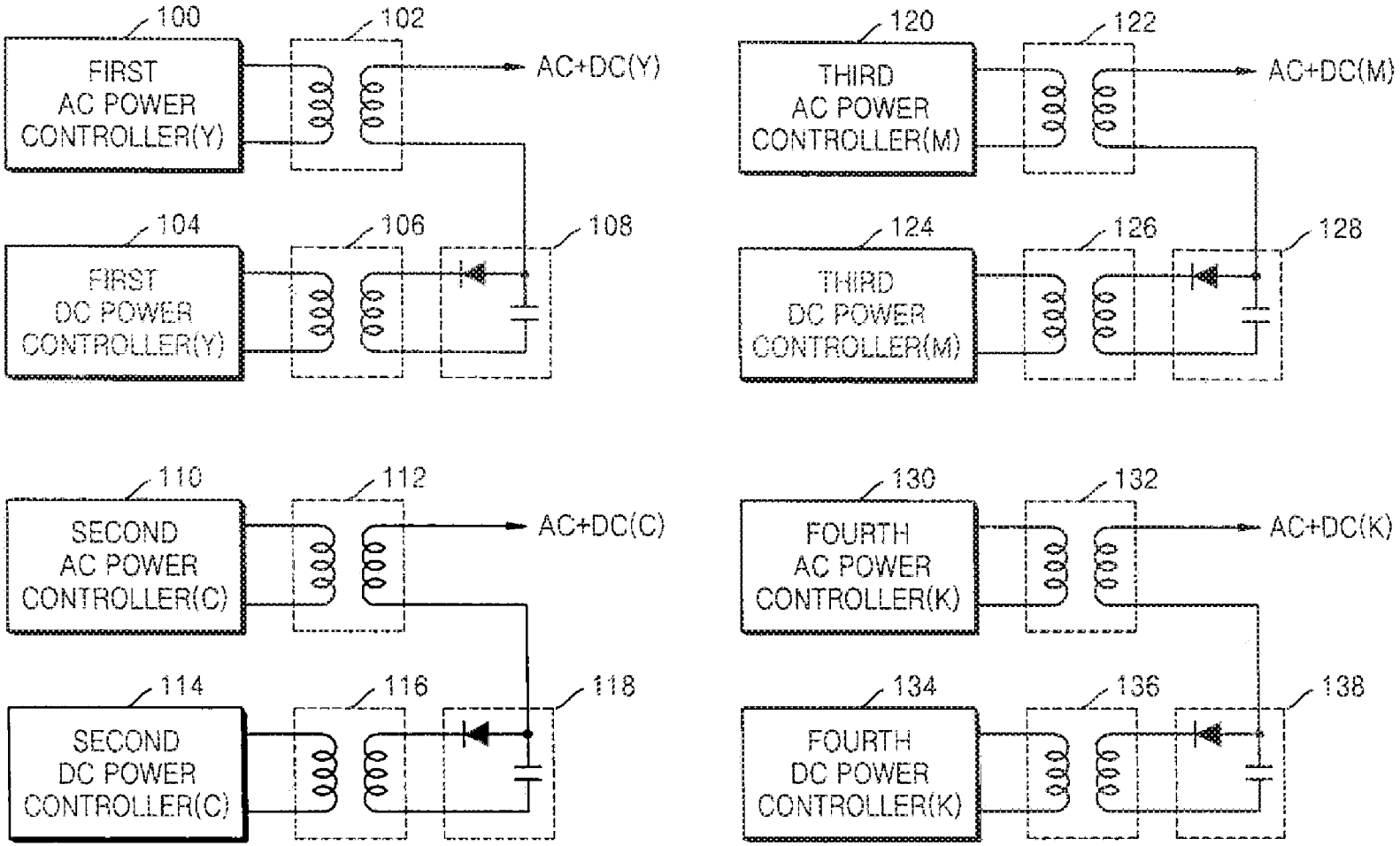
FIG. 1 (RELATED ART)
FIG. 1 is a circuit diagram of a conventional high voltage power controlling apparatus to control high voltage power supplied to each of a plurality of developers.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
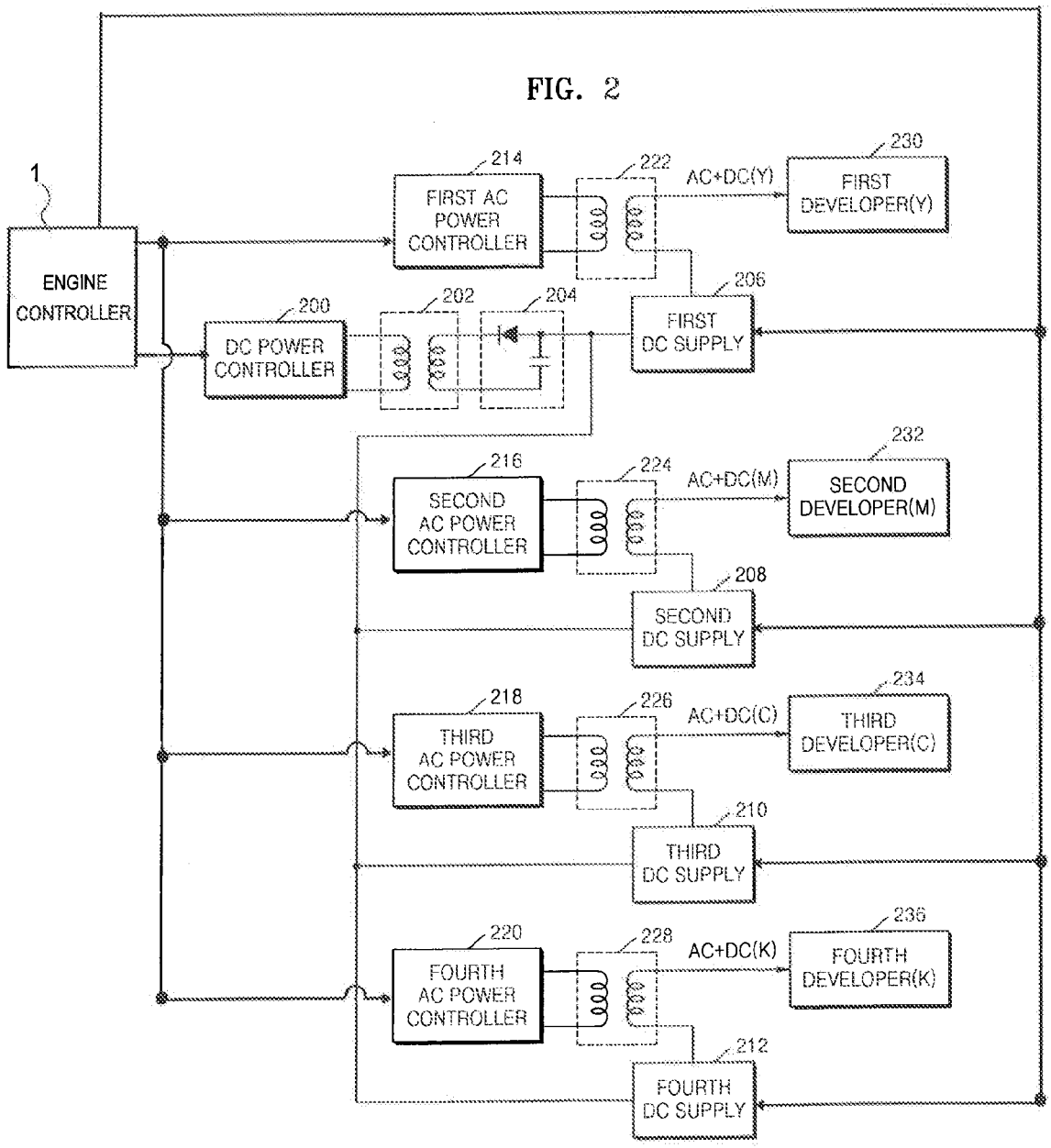
FIG. 2 is a circuit diagram illustrating a high voltage power controlling apparatus of an image forming apparatus, according to an embodiment of the present general inventive concept.

FIG. 2 is a circuit diagram illustrating a high voltage power controlling apparatus of an image forming apparatus according to an embodiment of the present general inventive concept. Referring to FIG. 2, the high voltage power controlling apparatus includes a direct current (DC) power controller 200, a first voltage transformer 202, a rectifier 204, first, second, third, and fourth DC supplies 206, 208, 210, and 212, first through fourth alternating current (AC) power controllers 214, 216, 218, and 220, and second, third, fourth, and fifth voltage transformers 222, 224, 226, and 228. The high voltage power controlling apparatus includes cyan (C), magenta (M), yellow (Y), and black (K) developers as later described. However, the components of the high voltage power controlling apparatus may vary depending on a number of developers being used.

The DC power controller 200 converts a first pulse width modulation (PWD) signal provided from an engine controller 1 into a switching waveform signal and outputs the switching waveform signal to a first side of the first voltage transformer 202. A detailed operation of the DC power controller 200 is similar to that described in the related art, and thus a detailed description thereof will be omitted herein.

The first voltage transformer 202 transforms the switching waveform signal output from the DC power controller 200 according to a turns ratio of the first voltage transformer 202 and outputs the transformed power to the rectifier 204. Since a transformer contains a certain number of turns of wire, the turns ratio is defined as the ratio of turns of wire in a primary winding of the transformer to the number of turns of wire in a secondary winding of the transformer. For example, if the turns ratio of the first voltage transformer 202 is 4 to 1, and 40 volts are placed across a primary winding of the first voltage transformer 202, 10 volts will result across a secondary winding of the first voltage transformer 202 (i.e., 40/4=10).

The rectifier 204 rectifies the power output from the first voltage transformer 202 into DC power and outputs the DC power to the first, second, third, and fourth DC supplies 206, 208, 210, and 212. To do so, the rectifier 204 includes a capacitor and a diode as illustrated in FIG. 2. A detailed operation of the rectifier 204 is similar to that described in the related art, and thus a detailed description thereof will be omitted herein.

The first, second, third, and fourth DC supplies 206, 208, 210, and 212 adjust the DC power rectified by the rectifier 204 to a predetermined level, and respectively output the DC power to second sides of the second, third, fourth, and fifth voltage transformers 222, 224, 226, and 228.

Figure 3:
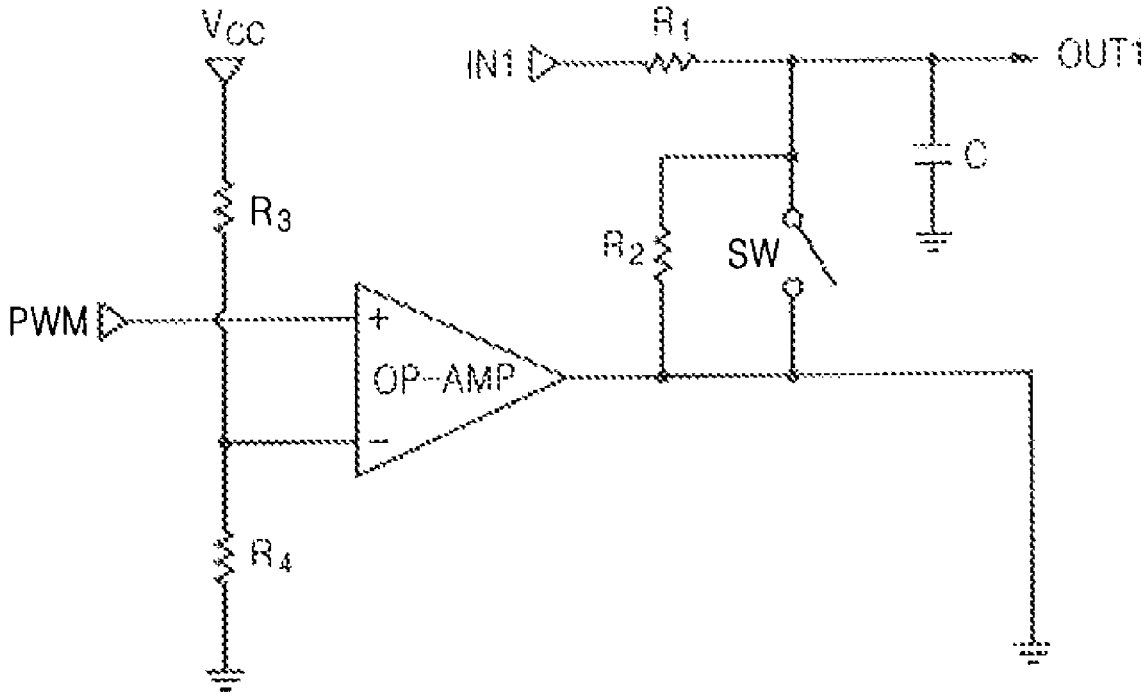
FIG. 3 is a circuit diagram of each first through fourth direct current (DC) supply of FIG. 2, according to an embodiment of the present general inventive concept.

FIG. 3 is a circuit diagram of each of the first, second, third, and fourth DC supplies 206, 208, 210, and 212 illustrated in FIG. 2, according to an embodiment of the present general inventive concept. As illustrated in FIG. 3, each of the first, second, third, and fourth DC supplies 206, 208, 210, and 212 includes first and second resistors R1 and R2, an operational amplifier OP AMP, a switching unit SW, and a capacitor C. If the DC power rectified by the rectifier 204 is input through an input node IN1, the first and second resistors R1 and R2 divide the rectified DC power according to a resistance ratio of the first and second resistors R1 and R2.

The operation amplifier OP AMP compares a third PWM signal input into a positive node with a reference voltage Vcc input into a negative node so as to output a comparison signal. More specifically, the third PWM signal input from the engine controller 1 is directly input into the positive node of the operational amplifier OP AMP, and the reference voltage Vcc is first divided by third and fourth resistors R3 and R4 and then is input into the negative node of the operational amplifier OP AMP. The operational amplifier OP AMP compares the third PWM signal with the divided reference voltage Vcc and then outputs the comparison signal obtained from the comparison result to the switching unit SW.

The switching unit SW performs a switching operation according to the comparison signal of the operational amplifier OP AMP so as to adjust a power level of DC power divided by the first and second resistors R1 and R2. The power level of the DC power that is to be supplied to a corresponding developer is adjusted by the switching operation of the switching unit SW, and the power level is complementary to power levels of DC powers that are to be supplied to other developers. The DC power having the adjusted power level is output to the second side of one of the second, third, fourth, and fifth voltage transformers 222, 224, 226, and 228, respectively, through an output node OUT1. The capacitor C, as illustrated in FIG. 3, smoothes any existing ripples of the DC power having the adjusted power level.

The first, second, third, and fourth AC power controllers 214, 216, 218, and 220 transform a second PWM signal provided from the engine controller 1 into switching waveform signals and respectively output the switching waveform signals to first sides of the second, third, fourth, and fifth voltage transformers 222, 224, 226, and 228. Detailed operations of the first, second, third, and fourth AC power controllers 214, 216, 218, and 220 are similar to that described in the related art, and thus detailed descriptions thereof will be omitted herein.

The second, third, fourth, and fifth voltage transformers 222, 224, 226, and 228 transform the switching waveform signals respectively output from the first, second, third, and fourth AC power controllers 214, 216, 218, and 220 according to turns ratios of each of the second, third, fourth, and fifth voltage transformers 222, 224, 226, and 228.

The transformed AC power of the second, third, fourth, and fifth voltage transformers 222, 224, 226, and 228 respectively overlaps with DC power having predetermined levels adjusted by the first, second, third, and fourth DC supplies 206, 208, 210, and 212 at the second sides of the second, third, fourth, and fifth voltage transformers 222, 224, 226, and 228. The AC and DC power of the second, third, fourth, and fifth voltage transformers 222, 224, 226, and 228 that overlap are respectively supplied to first, second, third, and fourth developers which are respectively located in first, second, third, and fourth developing units 230, 232, 234, and 236, and thus used as power to drive the first, second, third, and fourth developing units 230, 232, 234, and 236 that respectively include Y, M, C, and K developers. Each one of the first, second, third, and fourth developing the 230, 232, 234, and 236 may expel Y, M, C, and K developers, respectively, according to unique predetermined AC and DC power levels.

As described above, in a high voltage power controlling apparatus of an image forming apparatus according to the present general inventive concept, a number of voltage dividers to supply DC power and a number of rectifiers can be minimized to reduce a size of the image forming apparatus. Also, components of the image forming apparatus can be simplified so as to reduce a unit cost of the image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a DC (direct current) power controller to convert and output a first PWM (pulse width modulation) signal into a switching waveform signal;

a DC (direct current) power transformer to transform the switching waveform signal output from the DC power controller;

a rectifier to rectify the output power transformed by the DC power transformer into DC power;

first through fourth DC supplies to adjust and output the DC power rectified by the rectifier such that the DC power is adjusted to a respective predetermined level;

first through fourth AC (alternating current) power controllers to convert and output a second PWM signal provided from the engine controller into switching waveform signals;

first through fourth voltage transformers to transform the switching waveform signals output from the first through fourth AC power controllers and to combine the transformed AC powers and the adjusted DC powers having predetermined levels of the first through fourth DC supplies, respectively; and first through fourth developing units to receive the combined AC and DC powers from the respective first through fourth DC supplies and each expel a developer based on the received combined AC and DC powers, wherein each of the first through fourth DC supplies is supplied with the rectified DC power and performs a switching operation using a third PWM signal and the supplied DC power to adjust a power level of the DC power.

2. The image forming apparatus of claim 1, wherein each of the first through fourth DC supplies comprises first and second resistors to divide the rectified DC power;

an operational amplifier to compare the first PWM signal input into a positive node of the operational amplifier with a reference voltage input into a negative node of the operational amplifier, and to output a comparison signal; and a switching unit to perform a switching operation according to the comparison signal of the operational amplifier to adjust a power level of the DC power.

3. The image forming apparatus of claim 1, wherein each of the first through fourth DC supplies further comprises:

a capacitor to smooth the ripples of the DC power having the adjusted power level.

4. The image forming apparatus of claim 1, wherein the first through fourth developing units respectively are C (cyan), M (magenta), Y (yellow), and K (black) developing units.

5. A method of controlling a high voltage power of an image forming apparatus, comprising:

converting and outputting a first PWM (pulse width modulation) signal into a switching waveform signal;

transforming the switching waveform signal into an output power;

rectifying the transformed output power into DC power;

adjusting and outputting the rectified DC power using first through fourth DC (direct current) supplies, such that the rectified DC power is adjusted to a predetermined level;

converting and outputting a second PWM signal into switching waveform signals in first through fourth AC (alternating current) power controllers;

transforming the switching waveform signals output from the first through fourth AC power controllers to overlap the transformed powers with the DC powers having predetermined levels of the first through fourth DC supplies in a plurality of voltage transformers; and outputting the overlapped powers to first through fourth developers, respectively, wherein each of the first through fourth DC supplies divides the rectified DC power and performs a switching operation using a third PWM signal and the divided DC power, to adjust a power level of the DC power.

* * * * *